US006935142B2

(12) United States Patent
Musser et al.

(10) Patent No.: US 6,935,142 B2
(45) Date of Patent: Aug. 30, 2005

(54) WASHING MACHINE WATER CONTROL

(75) Inventors: Thomas A. Musser, St. Charles, IL (US); Frederick M. Gross, Barrington, IL (US)

(73) Assignee: Emerson Electric Co., St. Louis, MO (US)

( * ) Notice: Subject to any disclaimer, the term of this patent is extended or adjusted under 35 U.S.C. 154(b) by 479 days.

(21) Appl. No.: 10/036,643

(22) Filed: Dec. 31, 2001

(65) Prior Publication Data

US 2004/0143907 A1 Jul. 29, 2004

(51) Int. Cl.[7] ..... D06F 33/02

(52) U.S. Cl. ..... 68/12.16; 68/12.21; 68/12.27; 29/829; 29/831

(58) Field of Search ..... 29/825, 829, 831; 68/12.02, 12.03, 12.05, 12.16, 12.19, 12.21, 12.22, 12.27

(56) References Cited

U.S. PATENT DOCUMENTS

| | | | | | |
|---|---|---|---|---|---|
| 2,967,546 | A | * | 1/1961 | Sisson | 137/624.2 |
| 3,575,193 | A | * | 4/1971 | Niewyk et al. | 137/119.01 |
| 4,267,711 | A | * | 5/1981 | Kolze | 68/12.21 |
| 4,455,653 | A | * | 6/1984 | Le Gars et al. | 714/48 |
| 4,510,778 | A | * | 4/1985 | Cotton | 68/12.15 |
| 4,756,030 | A | * | 7/1988 | Juliver | 4/668 |
| 4,800,740 | A | * | 1/1989 | Huttemann | 68/12.12 |
| 4,854,498 | A | * | 8/1989 | Stayton | 236/12.12 |
| 5,070,565 | A | * | 12/1991 | Sood et al. | 8/159 |
| 5,074,003 | A | * | 12/1991 | Manson et al. | 8/159 |
| 5,140,493 | A | * | 8/1992 | Janicek | 361/211 |
| 5,231,722 | A | * | 8/1993 | Shacklock et al. | 8/159 |
| 5,241,257 | A | * | 8/1993 | Nordby et al. | 318/811 |
| 5,243,453 | A | * | 9/1993 | Kawaguchi et al. | 349/60 |
| 5,272,892 | A | * | 12/1993 | Janutka et al. | 68/12.02 |
| 5,439,019 | A | * | 8/1995 | Quandt et al. | 137/2 |
| 5,524,362 | A | * | 6/1996 | Quandt et al. | 34/526 |
| 5,735,007 | A | * | 4/1998 | Choi | 8/159 |
| 5,760,493 | A | * | 6/1998 | Outcalt et al. | 307/38 |
| 5,873,518 | A | * | 2/1999 | Richmond et al. | 236/12.12 |
| 5,978,995 | A | * | 11/1999 | Bruntz et al. | 8/158 |
| 6,049,930 | A | * | 4/2000 | Hisano et al. | 8/159 |
| 6,102,054 | A | * | 8/2000 | Diaz | 134/57 R |
| 6,125,490 | A | * | 10/2000 | Riechman et al. | 8/158 |
| 6,327,730 | B1 | * | 12/2001 | Corbett | 8/158 |
| 6,425,156 | B1 | * | 7/2002 | Knopp et al. | 8/159 |
| 6,499,321 | B1 | * | 12/2002 | Rhodes et al. | 68/12.03 |
| 6,634,048 | B1 | * | 10/2003 | Hornung et al. | 8/158 |
| 6,727,443 | B2 | * | 4/2004 | Peterson et al. | 200/50.34 |

FOREIGN PATENT DOCUMENTS

| | | | |
|---|---|---|---|
| JP | 4-58554 | * | 2/1992 |
| JP | 4-61366 | * | 2/1992 |
| JP | 10-337398 | * | 12/1998 |

* cited by examiner

*Primary Examiner*—Frankie L. Stinson
(74) *Attorney, Agent, or Firm*—Maginot, Moore & Beck

(57) ABSTRACT

Water temperature selection in a washing machine is accomplished by utilizing a single selector that is in communication with an associated processor. The single selector is preferably on the same board as the processor thereby defining a water temperature selection and control module. The water temperature selector and control module is in communication with various other selectors, sensors, detectors, inputs, or the like to receive signals therefrom. The input signals are processed by the processor to produce signals to control water flow for the washing machine. In one form, the single selector is a resistive potentiometer that provides a resistance signal to the processor. In this form, the processor is in communication with the water valves and directly energizes the water valves in accordance with the resistive signal from the potentiometer.

16 Claims, 8 Drawing Sheets

WASHING MACHINE WATER CONTROL

FIELD OF THE INVENTION

The present invention relates generally to washing machines and, more particularly, to water temperature selection and control in a washing machine.

BACKGROUND

Automatic washing machines for clothes (washing machines) have been in use for relatively some time. During that time the washing machine has progressed from manually driven to electrically driven. The development of the washing machine, especially the electric washing machine, has resulted in a variety of features and/or functions that provide for the proper washing of the many different types of clothes and other items in current use. With the advent of digital processing, current embodiments of washing machines have a plethora of features and/or functions to facilitate the washing procedure. These features and/or functions are, of course, implemented by the components of the washing machine. A current feature is water temperature selection. With water temperature selection, a user is able to select the temperature of the water going into the washing tub during various modes of operation of the washing machine.

Washing machines for clothes that have a water temperature selector as well as other selectable features and/or functions are thus currently available. With such washing machines, after the user actuates the water temperature selector to select the desired water temperature(s) used for a selected washing cycle, the washing machine provides the water at the selected temperature. Currently, a plurality of various components are necessary to implement the water temperature selection and provision function. The currently used components have various drawbacks. The number of components themselves is one drawback. The number of components, in turn, creates drawbacks such as connection problems.

As an example of the above, in the typical washing machine, seven devices are used to select and control the temperature and flow of water into the wash tub of the clothes washer. Two of the seven devices are the hot and cold water valves that allow water to flow into the wash tub when externally energized. A third device is a thermistor. The thermistor is located downstream from the hot and cold water valves and measures the water temperature. The thermistor measures water temperature by converting the temperature into a resistance. The measured resistance is then correlated to a water temperature. A fourth device is a mechanical pressure switch that limits the total amount of water allowed into the wash tub.

The remaining three devices are an electromechanical timer, a rotary selector, and an electronic control. These three devices provide selection of a desired water temperature, control of the flow of water to meet that selected temperature, and control as to when the water is to flow into the wash tub. The rotary selector module provides the user a method of selecting water temperature. Additionally, the rotary selector module contributes to the logical control of water tempering through mechanical switches. The electromechanical timer provides mechanical switches that control when water will flow into the wash tub. The electromechanical timer also contributes to the logical control of water tempering one timer switch determines when a fill should occur. Another switch determines if the fill is a wash or rinse period. Additionally, four other switches are part of the logic and drive circuit for determining how the water valves are energized during the fill for temperature control. Lastly, the electronic control uses discrete electronic components that also contribute to the logical control of water tempering.

It is axiomatic that all of these components must be connected (wired) properly in order to function appropriately. Such wiring is necessarily complicated due to the nature of such connections and the amount of connections. The number of components provides more chances for errors in wiring.

In view of the above, what is therefore needed is a simpler manner of controlling water parameters in a washing machine. Particularly, what is needed is a simpler manner of selecting and/or controlling water temperature in a washing machine. More particularly, what is needed is a simpler manner of providing water temperature selection and control of water temperature in a washing machine.

SUMMARY

The subject invention is a system that provides water temperature selection and control, an apparatus that implements water temperature selection and control, and a method of water temperature selection and control in and for a washing machine.

In one form, the subject invention provides a water temperature selector and a controller integrated as one component or module. The integrated water temperature selector and controller module is operative to receive signals from various washing machine sensors regarding various washing machine parameters (including temperature selection) and to generate and/or provide signals to valves to control incoming hot and cold water flowing into the washing tub. The water temperature selector/controller module may be implemented as electrical circuitry and/or digital logic including an input selector.

In another form, the subject invention is a water controller for a washing machine. The water temperature selection and control module includes a processor, a selector, and selector circuitry/logic. The selector is operative to allow a user to select a water temperature setting for the washing machine. The selector circuitry/logic is in communication with the selector and the processor. The selector circuitry/logic is operative to provide a signal representing the selected water temperature setting. The processor is operative to receive the selected water temperature setting signal and produce a control signal in response thereto. The control signal is operative to control water flow into the washing machine.

In another form, the subject invention is a method of solid state water temperature selection and control in a washing machine. The method includes the steps of: (a) receiving a water temperature setting signal from a water temperature selector of the washing machine; (b) processing the received water temperature setting signal; (c) producing a control signal in response to the received water temperature setting signal; and (d) providing the control signal to a water valve of the washing machine.

In yet another form, the subject invention is a solid state water temperature selection and control module for a washing machine. The solid state module includes a circuit board, a processor mounted to the circuit board, a selector, and selector circuitry. The selector is mounted to the circuit board and is operative to allow a user to select a water temperature setting for the washing machine. The selector circuitry is in communication with the selector and the processor, and is operative to provide a signal representing the selected water temperature setting. The processor is operative to receive the selected water temperature setting signal and produce a control signal in response thereto. The control signal is operative to control water flow into the washing machine.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views.

DETAILED DESCRIPTION

Figure 1:
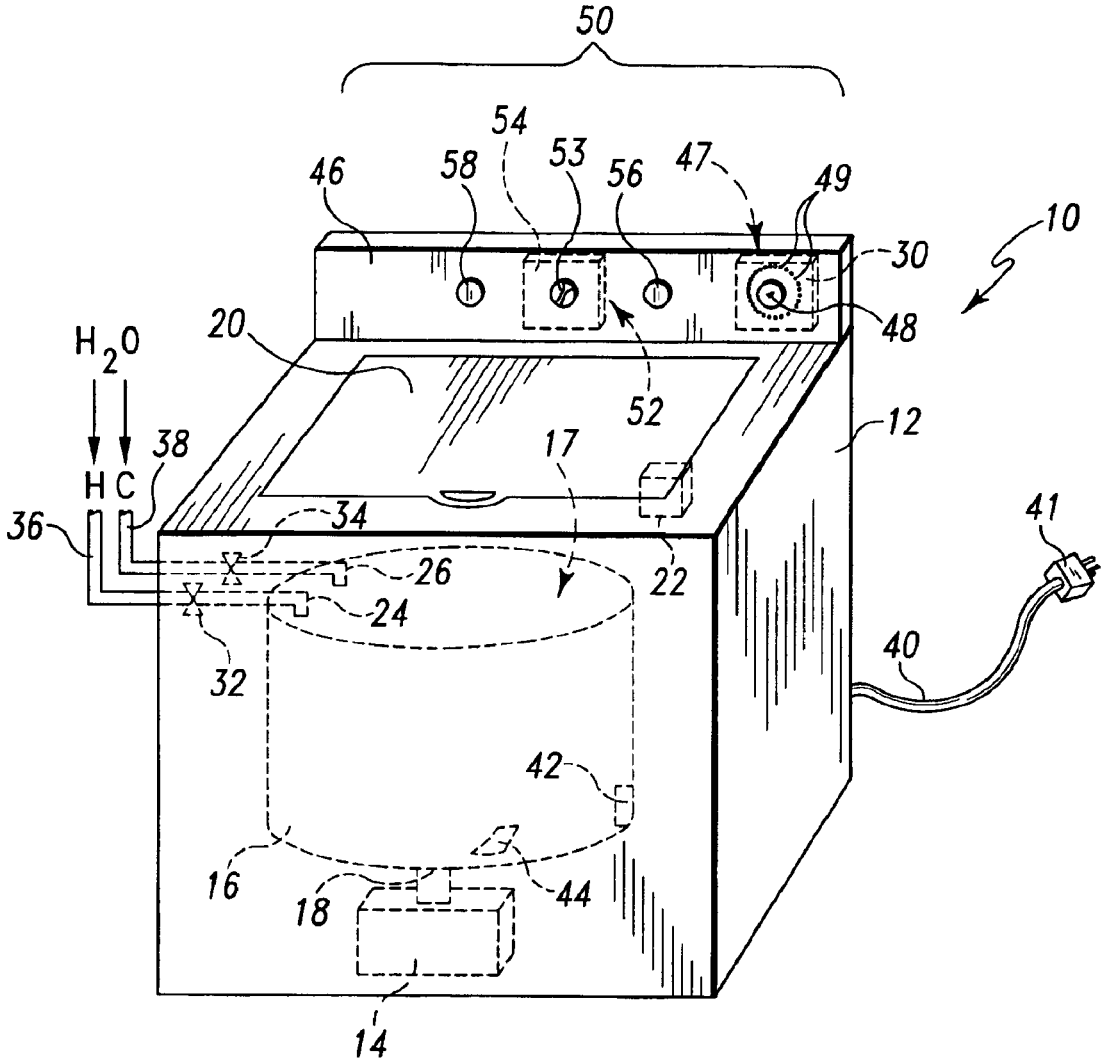
FIG. 1 is a perspective view of an exemplary washing machine embodying the subject invention.

Referring to FIG. 1, there is depicted a washing machine, generally designated 10, representing all forms of washing machines in which the subject invention may be embodied. As such, it should be appreciated that the washing machine 10 is only exemplary of a washing machine and is not intended to represent any particular type, make, or otherwise. Further, it should be appreciated that the lack of any feature and/or function of a washing machine not particularly shown and/or described in connection with the washing machine 10 is not intended to indicate that a washing machine embodying the subject invention does not include the feature and/or function. The washing machine 10 is representative of a washing machine that includes the subject invention.

The washing machine 10 has a frame or body 12 that houses a motor 14 and a washing receptacle or tub 16. The tub 16 defines an interior 17 in which articles or items, of preferably clothing, are held during washing. The tub 16 is also rotatably mounted within the frame 12. As such, the tub 16 is in communication with the motor 14 as via a shaft 18 or the like, so that the motor 14 is operative to drive the tub 16. A lid 20 is pivotally attached to the frame 12 via a hinge, hinges, or the like (not shown). The lid 20 allows access into the frame 12 and to the interior 17 of the tub 16. A lid or lid state detector 22 is attached to the frame 12 and positioned to provide detection of whether the lid is open or closed (i.e. the state of the lid). Typically the lid detector 22 is embodied as a switch (e.g. a normally open or normally closed type switch).

The tub 16 is adapted to receive water from a first tap, spigot or the like 24 and a second tap, spigot, or the like 26 each of which is situated to direct its outflowing water into the tub 16. The spigot 24 is in communication with a first valve 32, while the spigot 26 is in communication with a second valve 34. Each of the valves 32 and 24 are operative to automatically (non-manually) open and close (provide water flow and cease water flow, respectively) upon receipt of appropriate signals or commands.

The valve 32 and thus the spigot 24 are coupled to a hot water supply 36. When the valve 32 is open, hot water from the hot water supply 36 flows out of the spigot 24. When the valve 32 is closed, hot water ceases its flow to the spigot 24. Typically, water flow from the valve 32 (and thus the spigot 24) is either full on or full off. However, in one form, the valve 32 (and thus the spigot 24) is operative to provide a continuous range of water flows based on a continuous range of being fully closed to fully open [i.e. from 0% (fully closed) to 50% (half open/half closed) to 100% (fully open)].

The valve 34 and thus the spigot 26 are coupled to a cold water supply 38. When the valve 34 is open, cold water from the cold water supply 38 flows out of the spigot 26. When the valve 34 is closed, cold water ceases its flow to the spigot 26. Typically, water flow from the valve 34 (and thus the spigot 26) is either full on or full off. However, in one form, the valve 32 (and thus the spigot 26) is operative to provide a continuous range of water flows based on a continuous range of being fully closed to fully open [i.e. from 0% (fully closed) to 50% (half open/half closed) to 100% (fully open)]. It can be appreciated that the valves 32 and 34 are operative to provide a range of temperatures of water in the tub 16 by varying the amount of water flow therein (degree of the open/closed state of the valve) to provide either full cold, full hot, or a mixture of hot and cold water. This depends on the selected water temperatures.

The washing machine 10 has a console 46 as part of or separate from the frame 12 and attached thereto. The console 46 provides support for various controllers, selectors, inputs, and the like for user adjustable, selectable, and/or settable features and/or functions of the washing machine 10, which are generally designated 50 (and collectively, controllers and/or selectors). The console 46 also houses most of the logic and/or circuitry associated with the washing machine 10, particularly the selectors and/or controllers 50. In this example, the selectors and/or controllers 50 include a main selector, controller, or input module 47, a water temperature selector, controller, or input module 52, and two auxiliary inputs, selectors, or controllers 56 and 58. The auxiliary inputs 56 and 58 may, for example, be a load size selector and a fabric selector.

The main selector module 47 includes a main controller, processor, processing unit, control and/or processing circuitry/logic, and/or the like 30. In this embodiment, the controller 30 includes necessary circuitry and/or logic to provide the main processing for the washing machine 10, process user and machine inputs appropriately, provide outputs to various components when appropriate, and provide external indicators for the user. Without being exhaustive, the main selector module 47 provides cycle selection, start/stop, user indications of cycle progression, time selection, and the like. The main selector module 47 thus provides an interface for selection of operating modes of the washing machine and a machine-to-user interface for indicating selection and/or current operating mode of the washing machine 10.

The main selector module 47 also has a user interface or selector 48 that is embodied as a rotatable knob 48. It should be appreciated that the user interface or selector 48 may be embodied as another type of interface such as a touch-pad or the like. The knob 48 is encompassed by a plurality of indicators 49, such as LEDS. The knob 48 is coupled to the main controller 30 such that signals generated by and/or in response to rotation or movement of the knob 48, and/or its ending rotational position, are communicated and/or provided to the processing portion of the main controller 30. The main controller 30 utilizes the signals accordingly. The LEDS 49 provide a visual indication of the particular mode or cycle selection for the washing machine 10 and/or the current operating position in the chosen mode or cycle.

The water temperature selection/control module 52 has a user interface or selector 53 and is operative to receive input from a user via the selector 53 as to a particular water temperature setting. In the present case, the selector 53 is embodied as a rotatable knob. It should be appreciated that the selector 53 may be embodied as another type of interface such as a touch-pad or the like. Particularly, the selector 53 is operative to allow selection of water temperature for washing and rinsing. This is accomplished by the user through rotation of the knob 53.

The knob 53 is in communication with an electronic temperature control (ETC) board, control module or controller 54. The ETC or controller 54 is operative to receive and process signals generated and/or produced by the knob 53 and/or its constituent parts, as an interface to a signal generator, or as a variable parameter component. Particularly, the controller 54 is operative to receive signals as a result of the rotation of the knob 53 (or from any type of input) or are generated and/or produced as a result of an eventual setting or final position (rotational position) of the knob 53. The controller 54 uses the signal(s) from the knob 53 to provide the selected water temperature(s) to the tub 16 at the appropriate time.

The ETC 54 is in communication with appropriate components of the washing machine 10. Particularly, the ETC 54 is in communication with the valves 32 and 34 in order to provide actuation signals thereto (for opening the valves) and de-actuation signals thereto (for closing the valves). The ETC 54 is thus operative to control the valves 32 and 34 to provide a range of temperatures from cold (cold valve 34 full on, hot valve 32 full off) to hot (hot valve 32 full on, cold valve 34 full off). Additionally, the ETC 54 is in communication with the water temperature sensor 42 and the water level sensor 44. The ETC 54 receives and utilizes the signals from the water temperature sensor 42 and the water level sensor 44 to control the water going into and in the tub 16. The ETC 54 generates various control signals for the various components to accomplish water temperature control.

Figure 2:
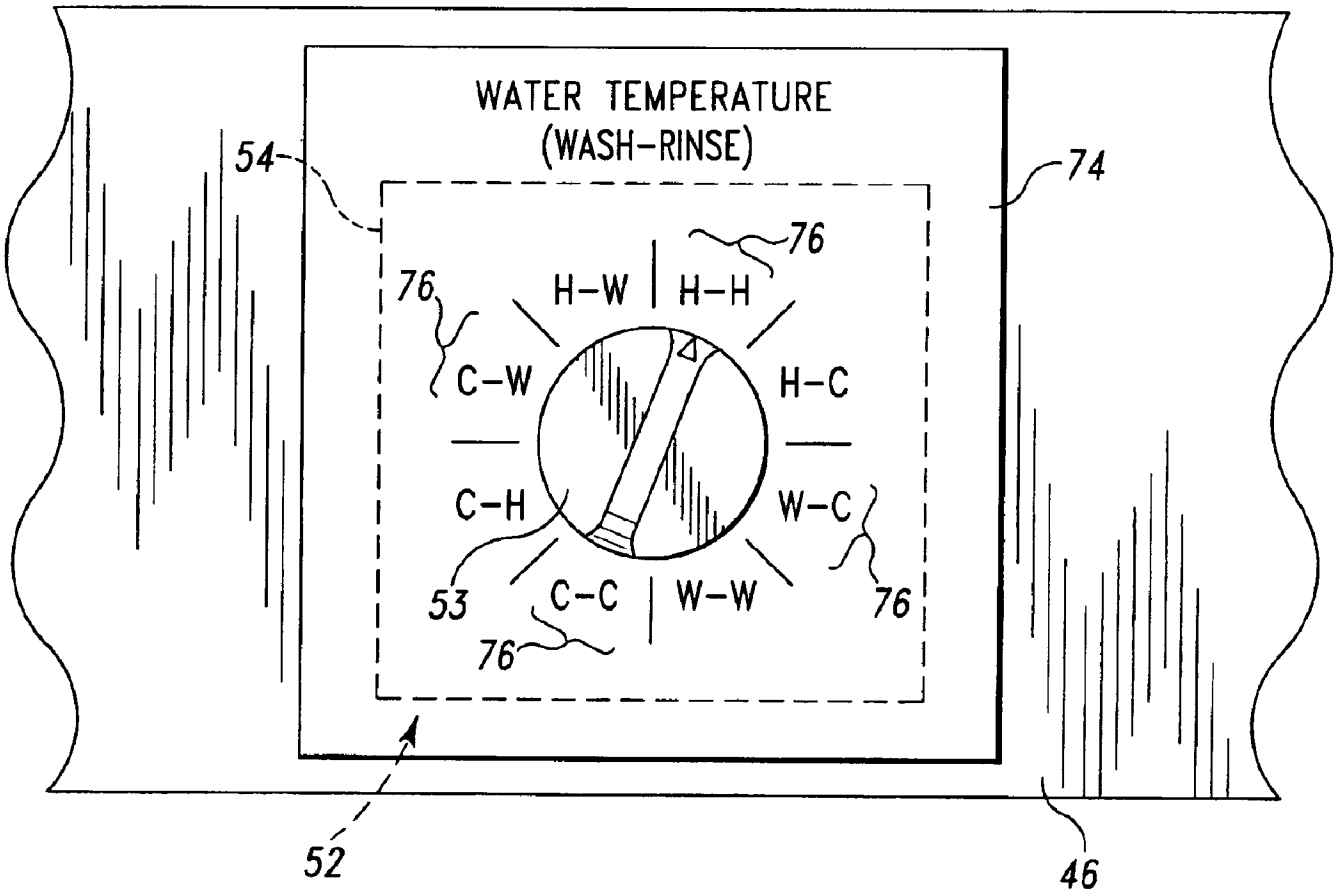
FIG. 2 is an enlarged top plan view of an exemplary embodiment of a water temperature selector and surrounding face for the exemplary washing machine of FIG. 1.

Referring to FIG. 2, there is depicted an exemplary face of the water temperature selector/controller module 52 and an exemplary water temperature selection scheme for the washing machine 10. Particularly, in FIG. 2 there is shown a portion of the console 46 that retains the electronic water temperature selection/control module 52. A plate, decal, label or the like 74 is located on the console 46 behind the knob 53. The plate 74 includes indicia indicating that the knob 53 is for water temperature selection (both for the wash cycle and the rinse cycle). The plate 74 is also divided into a plurality of sections 76, each section of which corresponds to a particular water temperature for wash and rinse. The designation "H" stands for hot. The designation "C" stands for cold. The designation "W" stands for warm.

In FIG. 2, the knob 53 is pointed toward "H—H" (hot-hot). Seven (7) other water temperature combinations are available as shown. It should be appreciated that the various temperature combinations as well as the number of temperature combinations (or sections 76) are arbitrary. The actual number of selections is in accordance with a particular manufacturer's washing machine capabilities and design. Therefore, the water temperature selection/control module 52 may provide more or less water temperature combinations as well as different water temperature combinations. As well, special water temperatures may be provided for by the water temperature selector/controller module 52.

The washing machine 10 also includes a water temperature sensor or detector 42 that may be positioned in or about the tub 16 (or any appropriate location). The water temperature sensor 42 is operative to obtain, detect, sense, measure, or the like, the temperature of the water that is flowing into the tub 16, is already in the tub 16, and/or is mixing in the tub 16. The water temperature sensor 42 is further operative to generate and/or provide a signal or signals indicative of or correlative to the temperature of the water. The water temperature signal or signals are provided to the ETC 54. In one form, the water temperature sensor 42 may be a thermistor.

The washing machine 10 also includes a water amount or level sensor/detector 44 that may be positioned within or about the tub 16 (or any appropriate location). The water level sensor 44 is operative to detect, sense, obtain, measure, or the like the amount of water and/or the level of water (collectively, liquid that may include water, detergent, bleach, laundry liquids, other general liquids, additives, etc.) in the tub 16 (in the interior 17 of the tub 16). The water level sensor 44 is further operative to generate a signal or signals indicative of or correlative to the amount and/or level of water in the tub 16. The water level signal or signals are provided to the ETC 54. In one form, the sensor/detector 44 is a pressure actuated device or switch, in which case the sensor/detector 44 may be mounted in the position depicted in FIG. 44, in another form, the sensor/detector 44 is a water level detector, in which case the sensor/detector 44 may be mounted proximate the opening of the tub 16/interior 17. Of course, other types of sensors/detectors may be used that may be located at different appropriate positions about the washing machine 10.

While not shown in FIG. 1, the washing machine 10 includes appropriate drainage components for draining the tub 16. Additionally, electricity to operate the washing machine 10 is supplied via a power cord 40 that has a plug 41 that is adapted to be received into an appropriate power or electricity receptacle (not shown). The receptacle is in communication with an appropriate source of electricity and is typically 120 volts AC. The power cord 40 is coupled internally to the various components of the washing machine 10 as appropriate.

Figure 3:
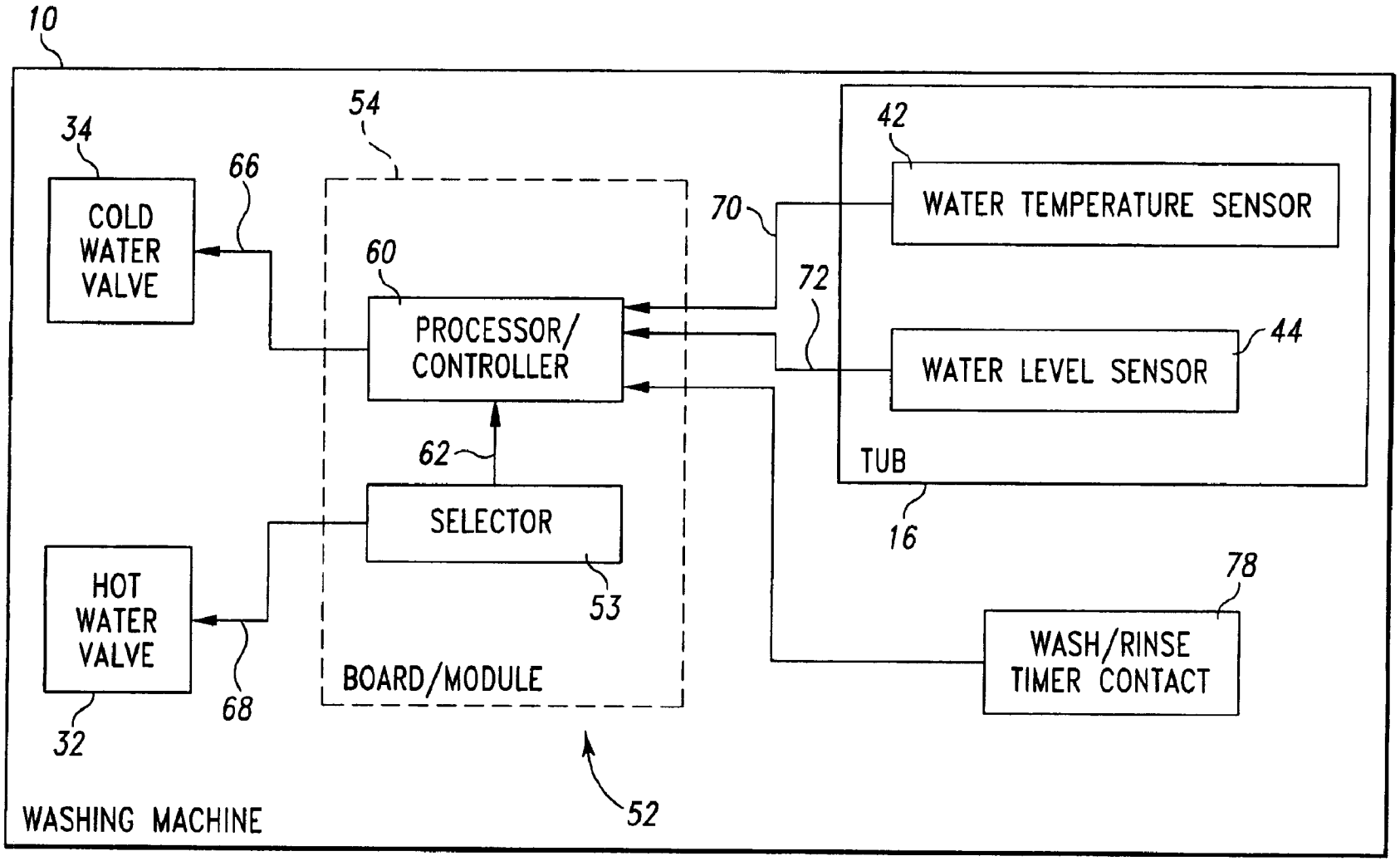
FIG. 3 is a block diagram of the exemplary washing machine of FIG. 1 showing various components thereof in accordance with the present principles.

Referring now to FIG. 3, there is depicted a block diagram of the exemplary washing machine 10. The water temperature selection/control module 52 includes a processor, controller, processing circuitry/logic 60 that is in communication with the selector 53 via a communication line 62. In this manner, signals generated by the selector 53 are provided to the processor 60. Particularly, position signals from the selector 53 are provided to the processor 60 which interprets the signals to ascertain the selected water temperatures and then provide signals to the hot water valve 32 via a communication line 68 and/or the cold water valve 34 via a communication line 66 as appropriate to control the temperature and flow of water into the tub 16.

The water temperature sensor 42 and the water level sensor are associated with the tub 16. The water temperature sensor 42 is in communication with the processor 60 via a communication line 70. The water temperature sensor 42 is operative to provide a signal or signals to the processor 60. The water temperature sensor signals indicate the water temperature of the water in the tub 16 (directly or by correlation) to the processor 60. The water level sensor 44 is in communication with the processor 60 via a communication line 72. The water level sensor 44 is operative to provide a signal or signals to the processor 60. The water level sensor signals indicate the level of the water in the tub 16 (directly or by correlation) to the processor 60. The processor 60 uses the water temperature sensor signals to adjust the flow of water into the tub 16.

Particularly, the processor 60 uses the water temperature signal(s) to determine the temperature of the water in the tub 16 and provides signal(s) to the cold water valve 34 and/or the hot water valve 32 depending on the temperature setting of the selector 53. The processor 60 uses the water level signal(s) to shut off the flow of water into the tub 16 when appropriate. Particularly, the processor 60 uses the water level signal(s) to determine when the tub 16 has an appropriate amount of water therein. The amount of water that is appropriate is typically determined by an auxiliary control that allows the user to select the load size (i.e. small, medium, or large). The size of the load typically determines the amount of water in the tub 16. When the appropriate amount of water is in the tub 16, the processor 60 provides signal(s) to the hot and/or cold water valves 32 and 34 to shut off the valves. Additionally, the washing machine 10 may includes a wash/rinse timer contact 78 that provides a signal or signals to the processor 60 indicating when it is wash time and when it is rinse time. The signal(s) from the wash/rinse timer contact 78 allow the processor 60 to control the hot and cold water valves 32 and 34 appropriately for the temperature of the water for the wash and rinse cycles of the washing machine 10.

Figure 4:
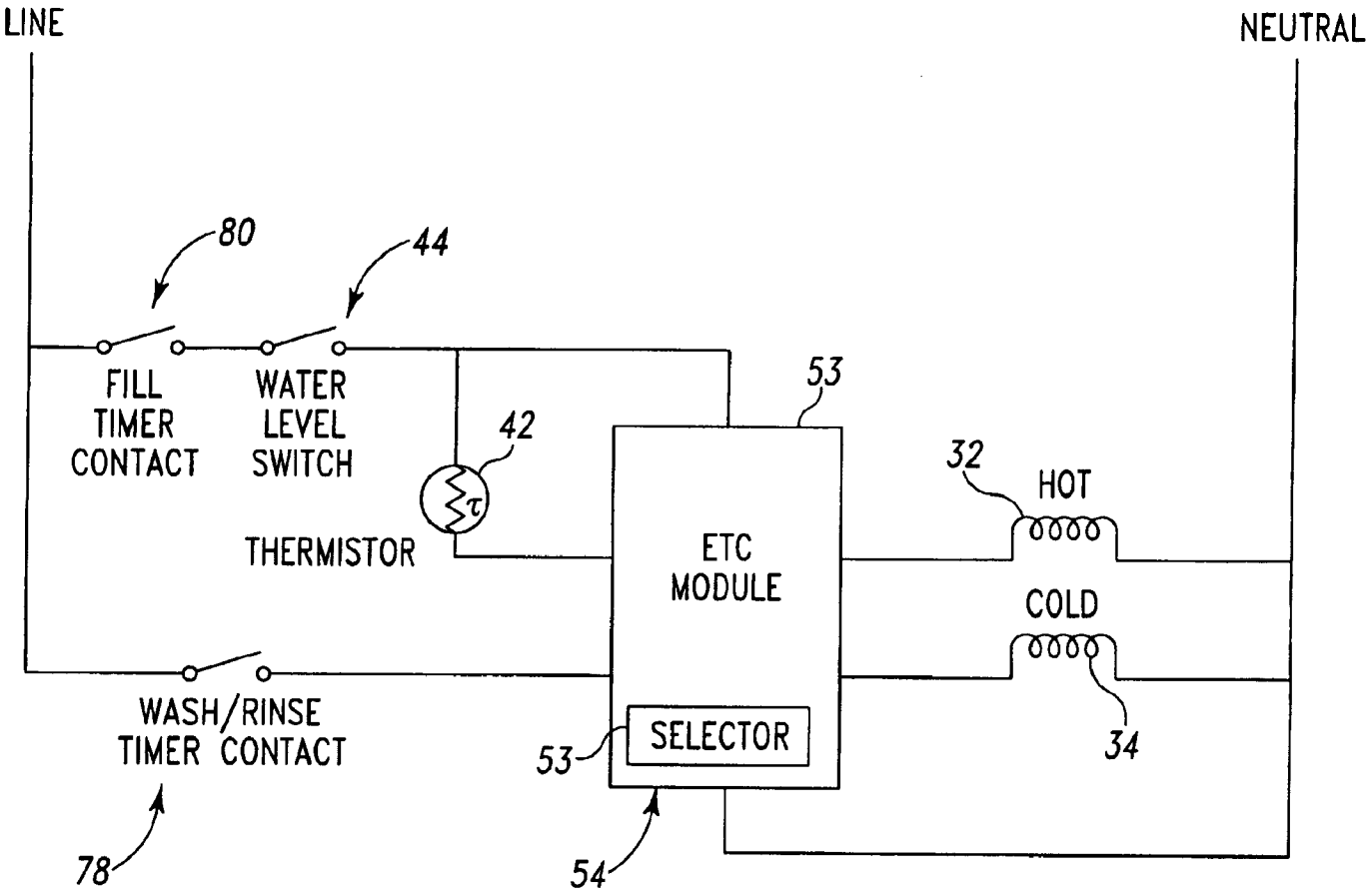
FIG. 4 is an electrical schematic of an exemplary embodiment of the subject invention including various washing machine components in accordance with the present principles.

Referring now to FIG. 4, there is depicted an exemplary wiring embodiment of the subject invention that expands on and implements the block diagram of FIG. 3. The hot water valve 32, shown as a solenoid (actuable coil), is coupled between the electronic temperature control (ETC) module 52 and neutral. Thus, a "hot water" signal from the ETC module 52 energizes the solenoid (valve) 32 to provide hot water. A cessation of the hot water signal from the ETC module 52 to the solenoid 32 or providing another signal to the solenoid 32, causes the solenoid 32 to close, thereby ceasing hot water flow. The cold water valve 34, shown as a solenoid (actuable coil), is coupled between the ETC module 52 and neutral. Thus, a "cold water" signal from the ETC module 52 energizes the solenoid (valve) 34 to provide cold water. A cessation of the cold water signal from the ETC module 52 to the solenoid 34 or providing another signal to the solenoid 34, causes the solenoid 34 to close thereby ceasing cold water flow.

The wash/rinse timer contact 78 is coupled to the ETC module 52 and line voltage (LINE) in order to provide a signal or signals to the ETC module 52 regarding the state of the washing machine 10 with respect to whether the washing machine 10 is in or should be in a wash mode or a rinse mode. The wash/rinse timer contact 78 may be wired such that a closed timer contact provides a signal to the ETC module 52 that indicates the wash mode, while an open timer contact provides a signal (no signal) that indicates the rinse mode. Of course, the wash/rinse timer contact 78 may be wired vice versa. The water level sensor 44 is here embodied as a water level switch 44 that is in communication with the ETC module 52 and a fill timer contact 80.

The ETC module 52 utilizes water temperature settings from the selector 53 and the various sensor/detector/switch inputs to selectively and controllably actuate the hot and cold water valves 32 and 34. In one form, the ETC module 52 is programmed to correlate the water temperature selector signals to a water temperature to actuate the appropriate water valves and utilize the sensor/detector/input signals to provide the valve actuating signal(s) at the appropriate time.

Figure 5A:
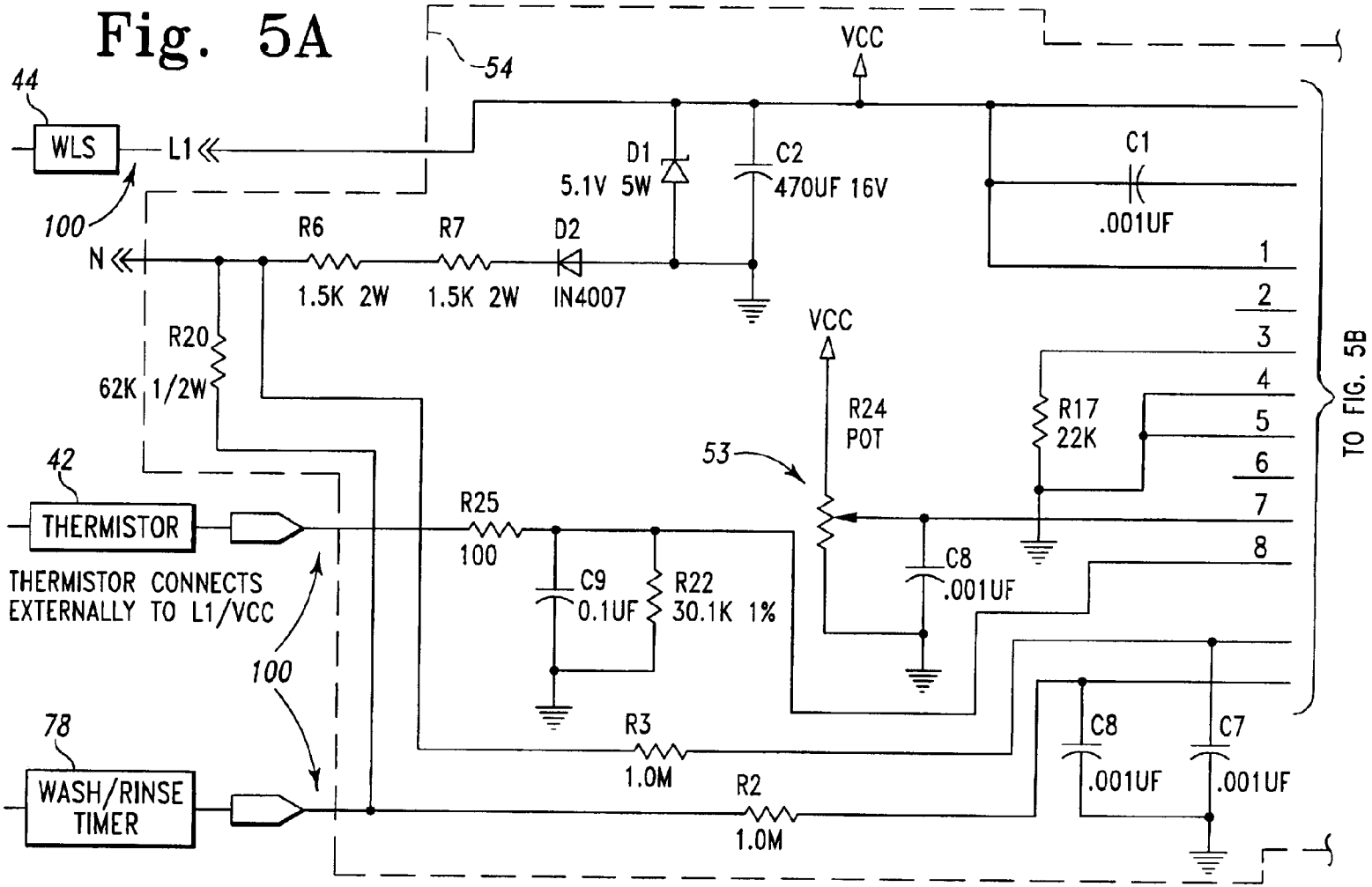
FIGS. 5A and 5B are is an electrical schematic of an exemplary embodiment of a water temperature selector/controller board in accordance with the present principles.
Figure 5B:
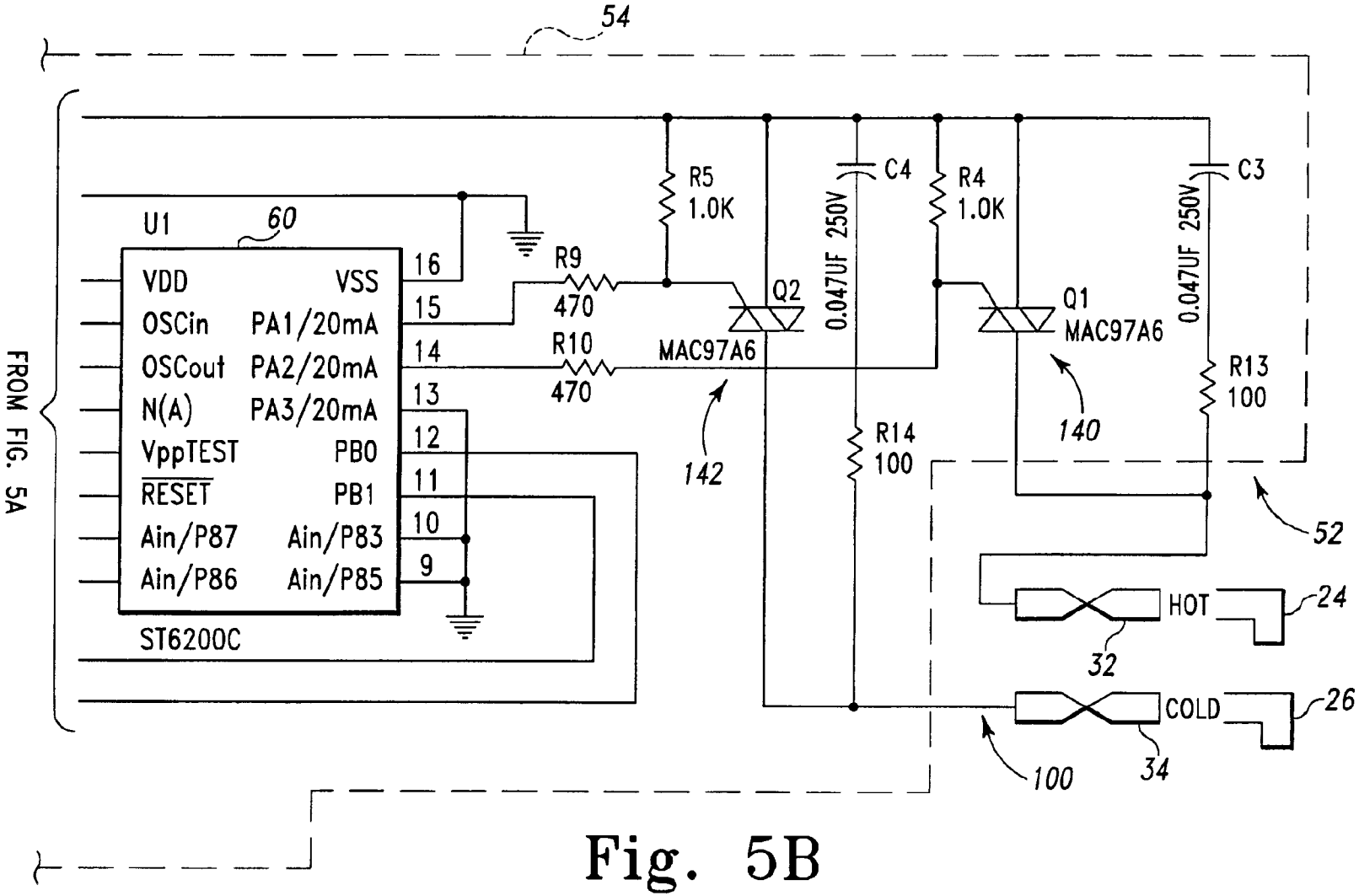

Referring to FIGS. 5A and 5B, there is depicted a detailed electrical schematic of an exemplary embodiment of the subject invention. Particularly, FIGS. 5A and 5B depicts the electrical portion of the ETC module 52 as coupled to the various sensors/detectors and the various components of the washing machine 10 for water temperature selection and control. More particularly, the board 54 is shown coupled to the selector 53, the water level sensor 44, the water temperature sensor 42, the wash/rinse timer 78, and the valves 32 and 34. The processor 60 is shown as an ST6200C manufactured by SGS Thomson. It should be appreciated that the ST6200C is only exemplary of an integrated circuit that is operative to provide the various features and/or functions described herein. Further, it should be appreciated that the various electrical components depicted in FIGS. 5A and 5B are only exemplary. While the processor 60 includes an internal oscillator for clocking, an extemal oscillator may be provided that would clock the processor 60. An external oscillator would be coupled to the input pin 2 (OSCin). The internal oscillator clock signals are provided at output pin 3 (OSCout).

The selector 53 is shown in FIG. 5A embodied as a potentiometer (pot). As such, the potentiometer 53 produces a variable resistance signal depending on the rotational position of the shaft of the potentiometer 53. The variable resistance signal is provided to the processor 60. The processor 60 receives the variable resistance signal and correlates the resistance (resistance signal) to a particular water temperature combination. Thus, the rotational position of the potentiometer (selector or knob) 53 provides the input for the processor 60 to determine (correlate) the wash and rinse water temperature. Using the exemplary water selection scheme as shown in FIG. 2, the detents 112 provide eight (8) water temperature (wash/rinse) settings. Each setting thus produces a particular resistance value or signal to the processor 60. Of course, other numbers of settings (detents) may be provided. In particular, the potentiometer 53 provides an analog signal that is or represents a resistance value to pin/input 7 (Ain/PB7) of the processor 60. The processor 60 includes a built-in analog to digital converter. The analog to digital converter is operative to receive input signals in analog form and convert the input analog signals into digital signals that are used internally and/or externally. Thus, the analog resistance value/signal input to the processor 60 is converted into a digital resistance value signal within the processor 60.

The digital resistance value signal is correlated (as, for example, via an internally stored look-up table, or the like) to a water temperature and/or to the generation and output of control signals that actuate the appropriate washing machine components to provide water at the selected temperature. In one form, the processor 60 is programmed to receive an analog signal from the selector 53 and utilize the received selector signal to provide output control signals to actuate water flow regulators. In the embodiment of FIGS. 5A and 5B, the processor 60 provides output signals to pin, pinout, or output 14 (PA2/20 mA) and to pin, pinout, or output 15 (PA1/20 mA). The output pin 14 is coupled to a gate of a triac 140 that serves as a driver for the valve (solenoid) 32 of the hot water. The output pin 15 is coupled to a gate of a triac 142 that serves as a driver for the valve (solenoid) 34 of the cold water. Actuation signals from output pins 14 and/or 15 actuate the respective triac 140, 142 and thus opens the respective valve 32, 34 causing water to flow from the spigots 24, 26. De-actuation signals (or the removal of the actuation signal from the pin 14/15 to create a no signal condition) shuts off the particular triac 140, 142 which closes the particular valve (solenoid) 32, 34. Any actuation signal may be provided over a sustained period of time, a brief period of time, or in varying and unvarying periodic time. In this manner, the water output from the valves 32 and 34 are controlled for amount and/or temperature.

The water level sensor 44 is coupled to the processor 60 so as to provide a water level signal thereto. Particularly, the water level sensor 44 is operative to provide a water level signal to the input pin 11 (PB1) of the processor 60. The water level signal may be provided only when the water level reaches a predetermined level within the tub 16. In this case, the water level signal would indicate to the processor 60 to shut off the water flow (should the water be flowing) or not to turn on the water (should the water not be flowing at that time). The processor 60 thus does not actuate the solenoid/valves 32, 34 via the respective triacs 140, 142.

The wash/rinse timer 78 is coupled to the processor 60 so as to provide a wash/rinse signal thereto. Particularly, the water level sensor 44 is operative to provide a wash/rinse signal to the input pin 12 (PB0) of the processor 60. The wash/rinse signal is provided to the processor 60 to indicate whether the washing machine 10 is in a wash mode or a rinse mode. The processor utilizes the wash/rinse signal(s) to control the valves 32, 34 appropriately.

The thermistor (water temperature sensor) 42 is coupled to the processor 60 so as to provide a water temperature signal. As indicated above, the water temperature signal may be a temperature signal, a resistance signal that is correlated to a temperature by the processor 60, or other type of signal. Particularly, the thermistor signal is provided to input pin 8 (Ain/PB6) of the processor 60. The processor 60 utilizes the thermistor signal to adjust the water valves 32 and 34 accordingly.

The various signals provided to the processor 60 are utilized by the processor 60 to produce signals for controlling and/or regulating other components of the washing machine 10, particularly, but not limited to, the water valves 32 and 34. The circuitry/logic of the embodiment shown in FIGS. 5A and 5B also includes conditioning circuitry/logic for the various signals.

Figure 6:
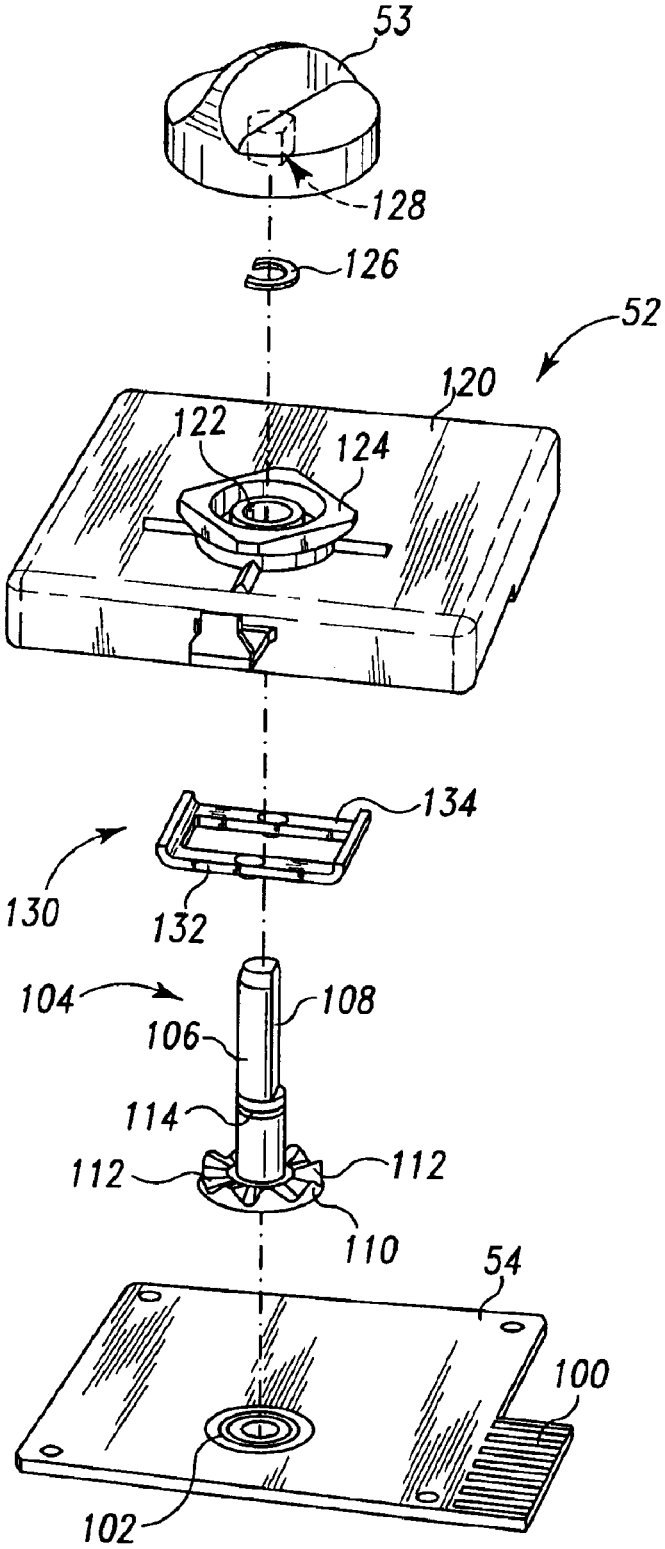
FIG. 6 is an exploded perspective view of an exemplary selector/controller module in accordance with the present principles.

Referring now to FIG. 6, there is depicted a physical embodiment of the water temperature selection/control module or packaging 52 in an exploded view. The water temperature selection/control module 52 includes the board 54 that is preferably a circuit board. As such the board 54 includes a plurality of terminals 100 that provide inputs and outputs to the various circuitry/logic of the board 54. The plurality of terminals 100 are ganged to permit the plurality of terminals to be coupled to a modular plug or the like. The board 54 also includes a circuit trace or tracings 102 that, together with a shaft assembly 104, provides variable signals as the shaft assembly 104 is rotated about the tracings 102. In one form, the tracings 102 and the base 110 of the shaft assembly 104 provides variable resistances depending on the rotational positioning of the base 110 of the shaft assembly 104 relative to the tracings 102. Alternatively, the tracings 102 and the shaft assembly 104 are embodied as a potentiometer such that the variable signals are variable resistances.

The shaft assembly 104 is thus adapted to rotate about the tracings 102. The shaft assembly 104 includes a shaft 106 having a flat 108 on one side thereof. The shaft 106 and flat 108 are configured to receive the knob 53. Particularly, the shaft 106 and the flat 108 are received in a complementary opening 128 in the knob 53. The flat 108 aligns with a flat (not seen) of the opening 128 to provide an orientation of the knob 53 when assembled onto the shaft 106. The shaft assembly 104 further includes a clip groove or channel in which is received a retention clip 126 when the shaft 106 is extended through a bore 122 in a housing 120. Particularly, when the shaft assembly 104 is assembled, the shaft 106 of the shaft assembly 104 extends through the bore 122 such that the clip groove 114 is exposed. The clip 126 thus retains the shaft assembly 104 to the housing 120. Thereafter, the knob 53 is received onto the shaft 106 and rests or abuts an annular track or flange 124 that is about the bore 122.

The shaft assembly 104 further includes the base 110 that has a plurality of notches or detents 112 annularly spaced thereabout. The detents 112 define rotational positions for the shaft assembly 104 that correspond to water temperature selections (or demarcations 76, see FIG. 2). The detents 112 cooperate with a detent/position clip 130 as described below to provide discrete rotational positions for the shaft assembly 104.

Particularly, the detent/position clip 130 is positioned at the underside of the housing 120 about the bore 122. The clip 130 includes first and second resilient arms 132 and 134 that straddle the bore 122 and the shaft 106. The detents 112 co-act with the arms 132 and 134 to releasably retain the rotational position of the shaft assembly 104 when rotated. Resistance by the arms 132 and 134 to rotational movement is overcome during rotation when the rotational force applied to the shaft assembly 104 through the knob 53 exceeds the resilience of the arms 132 and 134. This creates positive rotational "stops" or positions that correlate to water temperature selections. Preferably, the board 54 is affixed to the housing 120 by screws or the like. This holds the module 52, and thus its constituent components, together. The module 52 may thus be mounted to the frame 12 of the washing machine 10.

Figure 7:
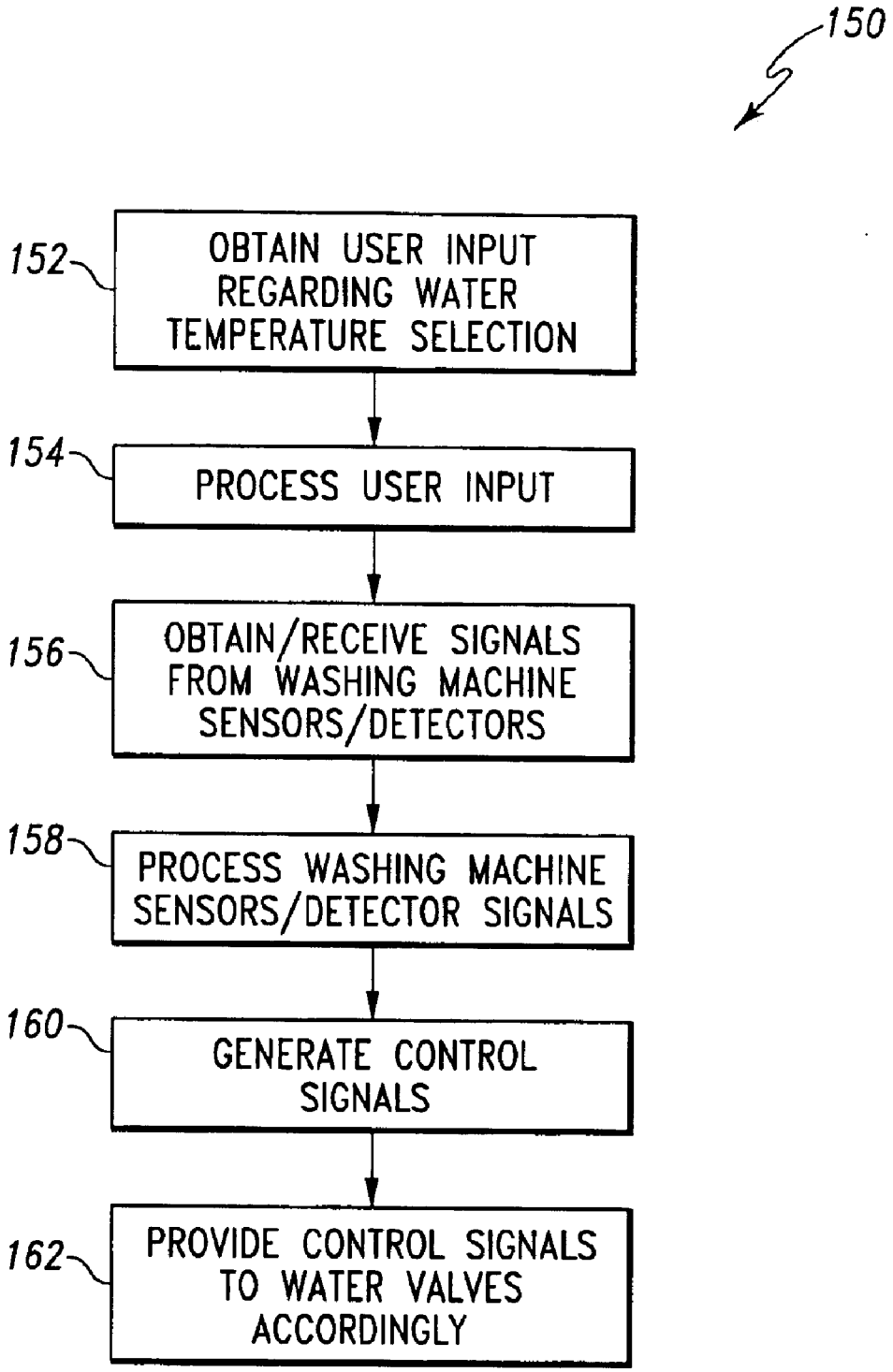
FIG. 7 is a flowchart of an exemplary manner of operation of the subject invention.

Referring to FIG. 7, there is depicted a flowchart, generally designated 150, of an exemplary manner of operation of the washing machine 10 and/or the water temperature selection/control module 52. Initially, it should be appreciated that a user provides input to the washing machine regarding a washing or operating cycle or mode of the washing machine and/or washing machine use. As examples, a user may select a "Permanent Press" washing mode or cycle, a "Delicate" washing mode or cycle, or a "Normal" washing mode or cycle. In the present example, this is accomplished through the main controller/selector 47 (see FIG. 1). Of course, other operating modes or cycles may be selected through the main controller/selector 47 as provided on the particular washing machine. As well, other features and/or functions may be selected and/or controlled through the main controller 47.

In step 152, the water temperature module 52 obtains user input regarding water temperature selection. In the present example, this is accomplished via rotation of the knob 53 associated with the water temperature module 52. The knob 53, the shaft assembly 104, and other associated parts thereof (see FIG. 6 and its associated description) provide selection signals to the processor 30 of the water temperature module 52. The selection signals indicate the water temperature selection(s) and/or setting(s).

In step 154, the received user input is processed. This may include correlating the received selection signals to temperatures as well as to control signals to provide water at the appropriate temperature. Before, during or after obtaining user selection input and/or processing the user selection input, in step 156 the water temperature module 52 obtains and/or receives signals from the various sensors and/or detectors of the washing machine. As examples, the water temperature sensor 42 may provide a signal to the processor 30 regarding the water temperature, while the water level sensor 44 may provide a signal to the processor 30 regarding water level. In step 158, the processor 30 processes the washing machine sensor/detector signals.

In response to these signals or inputs, in step 160, the water temperature selection/control module 52 generates or produces control signals. These control signals are used by components of the washing machine. In step 162, the valves 32, 34, use these control signals and their associated components, to start and stop hot and cold water flow for the washing machine 10.

While this invention has been described as having a preferred design, the subject invention can be further modified within the spirit and scope of this disclosure. This application is therefore intended to cover any variations, uses, or adaptations of the subject invention using its general principles. Further, this application is intended to cover such departures from the present disclosure as come within known or customary practice in the art to which this invention pertains and that fall within the limits of the appended claims.

What is claimed is:

1. A modular washing machine control comprising:

a circuit board;

a processor mounted on the circuit board, the processor having input lines and output lines;

a water valve driver mounted on the circuit board and being operatively coupled to the processor so that the processor operates a water valve by generating a signal on an output line of the processor that is coupled to the water valve driver;

a water temperature selector mounted on the circuit board and operatively connected to the processor so that a signal generated on the circuit board by the selector is received by the processor and used to control the signal on the output line to the water valve driver; and a housing mounted to the circuit board to enclose the water temperature selector, water valve driver, and processor so that the water temperature selector, water valve driver, and processor may be mounted to the frame of a washing machine as an integral unit.

2. The modular control of claim 1, the selector including:

a potentiometer mounted on the circuit board; and a shaft extending through the housing and operatively coupled to the potentiometer so that rotation of the shaft varies the resistance of the potentiometer and generates a variable signal on the circuit board for the processor to determine the water temperature for a washing machine.

3. The modular control of claim 2, the processor further including:

an analog-to-digital input coupled to the potentiometer for converting an analog signal received from the potentiometer to a digital value;

an internally stored lookup table; and the processor determining the selected water temperature by selecting a water temperature from the internally stored lookup table in accordance with the digital value for the analog signal received from the potentiometer.

4. The modular control of claim 3 further comprising:

a temperature sensor operatively coupled to the processor, the sensor for sensing temperature of water downstream of a water valve coupled to the water valve driver and for generating a temperature signal received by the processor; and the processor generates the signal coupled to the water valve driver in accordance with the water temperature selected from the internally stored lockup table and the temperature signal received from the temperature sensor.

5. The modular control of claim 4 further comprising:

a detent/position clip; and a series of detents carried by the shaft that engage the detent/position clip as the shaft is rotated to generate positive rotational stops for the shaft rotation that correlate to water temperature selections.

6. A method for forming an integral machine control module for mounting to the frame of a washing machine comprising:

mounting a processor having input lines and output lines on a circuit board;

mounting a water valve driver on the circuit board and operatively coupling the water valve driver to the processor so that the processor operates a water valve by generating a signal on an output line of the processor that is coupled to the water valve driver;

mounting a water temperature selector on the circuit board and operatively coupling the water temperature selector to the processor so that a signal generated on the circuit board by the selector is received by the processor to control the signal on the output line to the water valve driver; and enclosing the circuit board in a housing so that the water temperature selector, water valve driver, and processor may be mounted to the frame of a washing machine as an integral unit.

7. The method of claim 6, the selector mounting including:

mounting a potentiometer on the circuit board; and extending a shaft through the housing so the shaft is operatively coupled to the potentiometer whereby rotation of the shaft varies the resistance of the potentiometer and generates a variable signal on the circuit board for the processor to determine the water temperature for a washing machine.

8. The method of claim 7, the potentiometer mounting further including:

coupling the potentiometer to an analog-to-digital input of the processor to convert the signal from the potentiometer to a digital value; and selecting a water temperature from a lookup table internally stored in the processor in accordance with the digital value.

9. The method of claim 8 further comprising:

generating a signal corresponding to a temperature of water downstream of a water valve coupled to the water valve driver mounted on the circuit board; and generating a signal with the processor for controlling the water valve driver in accordance with the water temperature selected from the lookup table.

10. The method of claim 9 further comprising:

locating a series of detents about the shaft; and mounting a detent/position clip proximate the series of detents so that the detent/position clip engages the series of detents as the shaft is rotated to generate positive rotational stops for the shaft rotation that correlate to water temperature selections.

11. A modular washing machine control comprising:

a circuit board:

a processor mounted on the circuit board, the processor having input lines and output lines;

a water valve driver mounted on the circuit board and being operatively coupled to the processor so that the processor operates a water valve by generating a signal on an output line of the processor that is coupled to the water valve driver; and a water temperature selector mounted on the circuit board and operatively connected to the processor so that a signal generated on the circuit board by the selector is received by the processor and used to control the signal on the output line to the water valve driver.

12. The modular control of claim 11, the selector including:

a potentiometer mounted on the circuit board; and a shaft extending from the potentiometer and operatively coupled to the potentiometer so that rotation of the shaft varies the resistance of the potentiometer and generates a variable signal on the circuit board for the processor to determine the water temperature for a washing machine.

13. The modular control of claim 12, the processor further including:

an analog-to-digital input coupled to the potentiometer for converting an analog signal received from the potentiometer to a digital value;

an internally stored lookup table; and the processor determining the selected water temperature by selecting a water temperature from the internally stored lookup table in accordance with the digital value for the analog signal received from the potentiometer.

14. The modular control of claim 13 further comprising:

a temperature sensor for sensing temperature of water downstream of a water valve coupled to the water valve driver and for generating a temperature signal; and the processor generates the signal coupled to the water valve driver in accordance with the water temperature selected from the internally stored lookup table and the temperature signal received from the temperature sensor.

15. The modular control of claim 14 further comprising:

a detent/position clip; and a series of detents carried by the shaft that engage the detent/position clip as the shaft is rotated to generate positive rotational stops for the shaft rotation that correlate to water temperature selections.

16. The modular control of claim 12 further comprising:

a housing mounted to the circuit board to enclose the potentiometer, water valve driver, and processor so that the potentiometer, water valve driver, and processor form an integral unit.

* * * * *